US011753199B2

(12) United States Patent
Nitsch et al.

(10) Patent No.: US 11,753,199 B2
(45) Date of Patent: Sep. 12, 2023

(54) DEVICE AND METHOD FOR ATTACHING CARRYING HANDLES TO PACKAGING MEANS OR GROUPS OF PACKAGING MEANS

(71) Applicant: KHS GmbH, Dortmund (DE)

(72) Inventors: Thomas Nitsch, Kleve (DE); Stefan Van Heukelum, Kranenburg (DE); Stefan Wagner, Kleve (DE)

(73) Assignee: KHS GmbH, Dortmund (DE)

( * ) Notice: Subject to any disclaimer, the term of this patent is extended or adjusted under 35 U.S.C. 154(b) by 351 days.

(21) Appl. No.: 17/286,613

(22) PCT Filed: Sep. 18, 2019

(86) PCT No.: PCT/EP2019/075082
§ 371 (c)(1),
(2) Date: Apr. 19, 2021

(87) PCT Pub. No.: WO2020/094281
PCT Pub. Date: May 14, 2020

(65) Prior Publication Data

US 2021/0362899 A1 Nov. 25, 2021

(30) Foreign Application Priority Data

Nov. 7, 2018 (DE) ..... 10 2018 127 757.1

(51) Int. Cl.
*B65B 61/14* (2006.01)
*B65B 59/00* (2006.01)

(52) U.S. Cl.
CPC ..... *B65B 61/14* (2013.01); *B65B 59/001* (2019.05)

(58) Field of Classification Search
CPC ..... B65B 61/14; B65B 61/06; B65B 43/52; B65B 59/001
See application file for complete search history.

(56) References Cited

U.S. PATENT DOCUMENTS 6,901,720 B2 * 6/2005 Lechner ..... B65B 61/14 53/134.1
2003/0101685 A1 * 6/2003 Jansen ..... B65B 61/14 53/134.1

FOREIGN PATENT DOCUMENTS

DE 3715445 A1 11/1988
DE 69308878 T2 8/1997
DE 20207217 U1 * 8/2002 ..... B65B 61/14
DE 20207217 U1 8/2002
EP 0560699 A1 9/1993
(Continued)

OTHER PUBLICATIONS

Machine translation of DE-20207217-U1 (Year: 2002).*
Machine translation of EP-1088761-A1 (Year: 2001).*

*Primary Examiner* — Anna K Kinsaul
*Assistant Examiner* — Himchan Song
(74) *Attorney, Agent, or Firm* — Occhiuti & Rohlicek LLP

(57) ABSTRACT

An applicator for attaching a handle comprises three arms, each of which extends radially from the horizontal axis along an arm axis. Each of the arms comprises a cutter, a holder, and a displacer. The holder comprises a pneumatic interface for using negative pressure to hold or guide an endless band as well as the carrying handle that results therefrom. The displacer displaces the pneumatic interface along a direction defined by the arm axis.

15 Claims, 9 Drawing Sheets

(56) References Cited

FOREIGN PATENT DOCUMENTS

| | | | | |
|---|---|---|---|---|
| EP | 1088761 A1 * | 4/2001 | ..... | B65B 61/14 |
| EP | 1088761 A1 | 4/2001 | | |

* cited by examiner

DEVICE AND METHOD FOR ATTACHING CARRYING HANDLES TO PACKAGING MEANS OR GROUPS OF PACKAGING MEANS

RELATED APPLICATIONS

This is the national stage of PCT/EP2019/075082, filed on Sep. 18, 2019, which claims the benefit of the Nov. 7, 2018 priority date of German application DE 10 2018 127 757.1, the contents of which are incorporated herein by reference.

FIELD OF INVENTION

The invention relates to packaging, and in particular, to carrying handles on packages.

BACKGROUND

Goods of all kinds are today, as a rule, packed in packages or packages of packages to simplify transport, to safeguard the goods themselves against damage or loss, and for improved presentation, thereby promoting sales.

In some cases, individually packed goods, such as beverages filled in bottles, are grouped together to form packages or bundles, such as six-packs. These are sometimes shrink-wrapped or joined by adhesive to form a mechanically-stable unit. These then grouped together to form tray packs. It is often desirable to provide such packages with a carrying handle.

The handle is typically a strip having adhesive on one side. The ends of the handle are pressed on a package and the middle of the handle is covered by a paper strip to avoid contact with the customer's hands.

SUMMARY

The object of the present invention is therefore to provide a device and method for the attachment of carrying handles to packaging means or groups of packaging means which is largely improved in comparison with the prior art described, which does not exhibit the disadvantages of the prior art, and, in particular, allows for a simple format adjustment to different lengths and application heights of a carrying handle.

According to one aspect, the invention relates to a device for the attachment of carrying handles to packaging means or groups of packaging means, by which the packaging means or groups of packaging means being conveyed on a transport device in a transport direction can be provided in each case with at least one carrying handle, wherein the carrying handle is preferably configured as a self-adhering carrying handle. The device comprises for this purpose a carrying handle applicator unit which can be driven by a motor, and which can be driven by the transport device mounted about a horizontal axis of rotation transverse to the transport direction. In this situation, the carrying handle applicator unit comprises at least two applicator arms oriented radially relative to the axis of rotation, each of which extend along a longitudinal axis that intersects and is oriented away from the axis of rotation and on each of which at least one holding and/or pressing device and a cutting tool are designed so that an endless band provided at least in sections with an adhesive layer can be conveyed over a packaging means or a group of packaging means, from which a carrying handle can be detached which has an adhesive section at each free end, and the carrying handle formed in such a way can be applied onto the packaging means or the group of packaging means, in particular by being pressed on. According to the invention, the respective holding and/or pressing device has at least one suction area for at least temporarily holding and/or guiding the endless band and the carrying handle detached from it by means of a vacuum which can be at least temporarily created. The present invention is characterized in particular in that the at least one suction area of each holding and/or pressing device of the corresponding applicator arm is designed to be displaceable along the associated longitudinal axis by means of a displacement device. Particularly advantageously, the device according to the invention is therefore designed so as to carry out, in a simple manner, a format adjustment to carrying handles of different lengths and different attachment heights of a carrying handle, in that, due to the capacity of the suction areas to be displaced by means of the displacement device, the relative distance interval between two suction areas provided on adjacent applicator arms and the relative distance interval of the suction areas to the transport plane can be changed, and therefore can be adjusted to the respective length of a carrying handle taken up between them, and/or adjusted to the attachment height.

In some embodiments, provision can be made for the respective suction region of a corresponding applicator arm to be configured as displaceable by means of the displacement device along an adjustment path between a first length and a second length.

In some embodiments, provision can be made for the respective holding and/or pressing device, with the at least one suction area of the corresponding applicator arm formed on it, to be configured so as to be displaced by means of the displacement device along the associated longitudinal axis.

In some embodiments, provision can be made for the corresponding applicator arm to comprise in each case a proximal arm section, and a distal arm section which in each case can be displaced by means of the displacement device relative to the proximal arm section along the associated longitudinal axis, wherein the respective holding and/or pressing device, with its at least one suction area arranged on it, is assigned to the respective distal arm section.

In some embodiments, provision can be made for the respective distal arm section to be configured so as to be displaceable by means of the displacement device between a retracted position and/or extended position relative to the associated proximal arm section, in such a way that the corresponding applicator arm exhibits in its respective retracted position the second length and in its extended position exhibits the first length.

In some embodiments, provision can be made for the respective distal arm section to be configured so as to be displaceable by means of the displacement device continuously between the retracted position and the extended position, such that the corresponding applicator arm can be moved into all intermediate settings between the first length and the second length.

In some embodiments, provision can be made for the displacement device to comprise at least one right-angle gear device and a thread cutting device, in order to convert a rotating drive movement which has been initiated into a translational displacement movement of the respective distal arm sections, which can be produced by means of the worm gear device.

In some embodiments, provision can be made for a contact element to be provided in the respective bend section, which can be changed and/or replaced in the perpendicular extension to the drive shaft and/or in the height above the bend section. This stop element can in each case comprise a suction area for holding and/or fixing a carrying handle by means of a negative pressure or vacuum.

In some embodiments, provision can be made for the corresponding suction device provided between two applicator arms to be subjected at least temporarily to at least one negative pressure level and/or overpressure level depending on its position, in particular its rotational position.

In some embodiments, provision can be made for the corresponding suction device to be configured so as to be displaced by means of a further displacement device perpendicular to the axis of rotation DA and/or parallel to the corresponding longitudinal axis.

In some embodiments, provision can be made for the relative distance interval of the respective suction device to the axis of rotation DA, and/or the relative distance interval to suction region provided on the face side on the corresponding applicator arm, to be adjustable.

According to another aspect, the invention relates to a method for attaching carrying handles to packaging means or groups of packaging means, with which the packaging means or groups of packaging means being conveyed on a transport device in a transport direction are provided in each case with at least one self-adhering carrying handle, with which an endless band, provided at least in sections with an adhesive layer, is conveyed in each case over a packaging means or a group of packaging means, from which a carrying handle is detached, in each case with an adhesive section on the free end side, and the carrying handle which is formed in this way is pressed onto the packaging means or the group of packaging means, and which is characterized in that the carrying handle is applied to the packaging means or the group of packaging means by a device according to the invention.

As used herein, "package" refers to packaging elements or containers which are conventionally used in the food sector, and in particular in the beverage sector, and more specifically containers, such as bottles, cans, and also soft packaging, for example such as are produced from cardboard and/or plastic film and/or metal foil, transport containers, such as bottle boxes, etc.

As used herein, a "bundle" comprises one or more packages assembled into a unit.

The expression "essentially" or "approximately" signifies in the meaning of the invention deviations from an exact value in each case by +/−10%, preferably by +/−5%, and/or deviations in the form of changes which are not of significance with regard to the function.

Further embodiments, advantages, and possible applications of the invention also derive from the following description of exemplary embodiments and from the Figures. In this situation, all the features described and/or represented in the Figures are in principle the object of the invention, alone or in any desired combination, regardless of their combination in the claims or reference to them. The contents of the claims are also deemed to be constituent parts of the description.

Although several aspects have been described in connection with a device, it is understood that these aspects also represent a description of the corresponding method, such that a block element or a structural element of a device is also to be understood to be a corresponding method step or as a feature of a method step. By analogy with this, aspects which have been described in connection with, or as, a method step, also represent a description of a corresponding block or detail or feature of a corresponding device. Some or all of the method steps can be carried out by a hardware apparatus (or with the use of a hardware apparatus), such as, for example, a microprocessor, a programmable computer, or an electronic circuit. In some exemplary embodiments, some or a large number of the most important method steps can be carried out by such an apparatus.

The invention is described in greater detail hereinafter on the basis of the Figures in relation to exemplary embodiments. The Figures show:

Identical reference numbers are used in the figures for elements of the invention which are the same or have the same effect. Moreover, for easier overview, only reference numbers are represented in the individual Figures which are required for the description of the respective Figure. The invention is also represented in the Figures only in a schematic view in order to explain the mode of operation. In particular, the representations in the Figures serve only to explain the underlying principle of the invention. For reasons of better overview, the representation of all the constituent parts of the device has deliberately been avoided, since these are known from the prior art.

DETAILED DESCRIPTION

Figure 1:
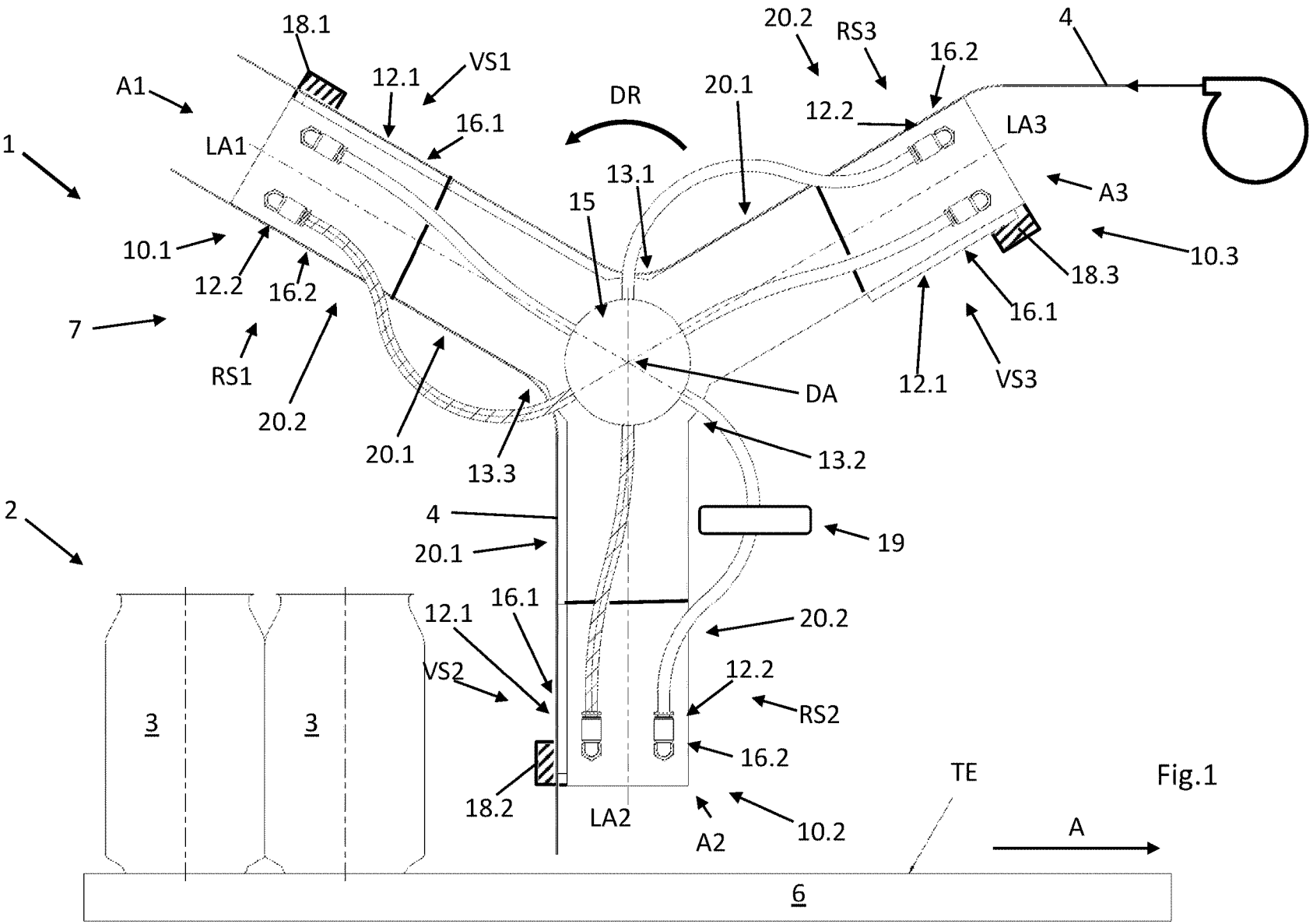
FIG. 1 shows an apparatus for attaching handles to packages.

FIG. 1 shows an apparatus 1 for attaching handles 4 to bundle 3 of one or more packages 2. Each handle 4 is a carrying loop that is secured, at ends thereof, to opposite sides of the bundle 3 in any of a variety of ways. Examples include adhesive bonding and welding. A suitable material for a handle 4 is plastic.

As used herein, a "bundle" of packages includes one or more packages within it. In some embodiments, a bundle 3 is a set of containers arranged in an array with two rows. In some cases, the packages 2 are bonded together by for example shrink-wrapping or adhesive spots to form a bundle 3.

The apparatus 1 is disposed above a transporter 7 on which bundles 3 of packages 2 move along a transport direction A on a transport plane TE. The apparatus 1 provides each bundle 3 with a handle 4, which is preferably a self-adhering carrying handle.

The apparatus 1 features an applicator 7 that draws a length of material from a long strip of band material that is kept in a store, which has been omitted for clarity. This length of material forms the handle 4. The applicator 7 then attaches the handle's ends to the bundle 3.

A motor rotates the applicator 7 about an axis-of-rotation DA that is perpendicular to the transport direction A and parallel to the transport plane TE. The axis-of-rotation DA is thus horizontal. The motor drives the applicator 7 in a rotation direction DR that is counter-clockwise when oriented as shown in the figure. A height adjuster, which is not shown in detail, raises or lowers the applicator 7 relative to the transport plane TE.

The applicator 7 includes at least two arms A1, A2, A3 that extend radially from the axis-of-rotation DA. In the illustrated embodiment, there are three such arms A1, A2, A3. Each arm A1, A2, A3 is an essentially rectangular structure that extends along a corresponding longitudinal axis LA1, LA2, LA3. The longitudinal axes LA1, LA2, LA3 of the arms A1, A2, A3 intersect at the axis-of-rotation DA. The angles between adjacent arms are equal. With three arms, the angle is 120 degrees.

Each arm A1, A2, A3 forms, on its longitudinal side faces, pointing into the plane of the figures, a front side VS and a rear side RS. The first arm A1 comprises a first front side VS1 and a first rear side RS1; the second arm A2 comprises a second front side VS2 and a second rear side RS2; and the third arm A3 comprises a third front side VS3 and a third rear side RS2. For each arm A1, A2, A3, a bend 13.1, 13.2, 13.3 extends between the arm's rear side RS1, RS2, RS3 and a front side VS1, VS2, VS3 of an arm A1, A2, A3 that is adjacent to it.

At the end of each arm A1, A2, A3 is a holder 10.1, 10.2, 10.3, which functions as both a holding device and a pressing device. The end of each arm also has a cutter 11.1, 11.2, 11.3 to cut a handle 4 off an endless strip of material. The cutter 11.1, 11.2, 11.3 is formed as a retractable blade on a distal face of its corresponding arm A1, A2, A3. The holder 10.1, 10.2, 10.3 and cutter 11.1, 11.2, 11.3 cooperate to convey the band material over a bundle 3, to detach it to form the carrying handle 4, and to press an adhesive on the handle 4 onto the bundle 3.

Each holder 10.1, 10.2, 10.3 comprises first and second pneumatic interfaces 12.1, 12.2. The first pneumatic interface 12.1 is provided on the corresponding front side VS1, VS2, VS3 and the second pneumatic interface 12.2 is provided on the corresponding rear side RS1, RS2, RS3 of the applicator's holder 10.1, 10.2, 10.3. The first and second pneumatic interfaces 12.1, 12.2 hold and guide the carrying handle 4. The pneumatic interfaces 12.1, 12.2 achieve this by applying a negative pressure or vacuum.

The first pneumatic interface 12.1 comprises a first plate-shaped format part 16.1 arranged on the corresponding front side VS1, VS2, VS3, in the region of an associated holder 10.1, 10.2, 10.3. The second pneumatic interface 12.2 includes an opening in a second plate-shaped format part 16.2 that is arranged on the corresponding rear side RS1, RS2, RS3 in the region of an associated holder 10.1, 10.2, 10.3. Bothe the first and second format parts 16.1, 16.2 are formed from an elastic material, such as a foam. This enables them to both hold and guide the endless band and the carrying handle 4 that is ultimately detached from band and to also press the detached carrying handle 4 onto the bundle 3.

Figure 5:
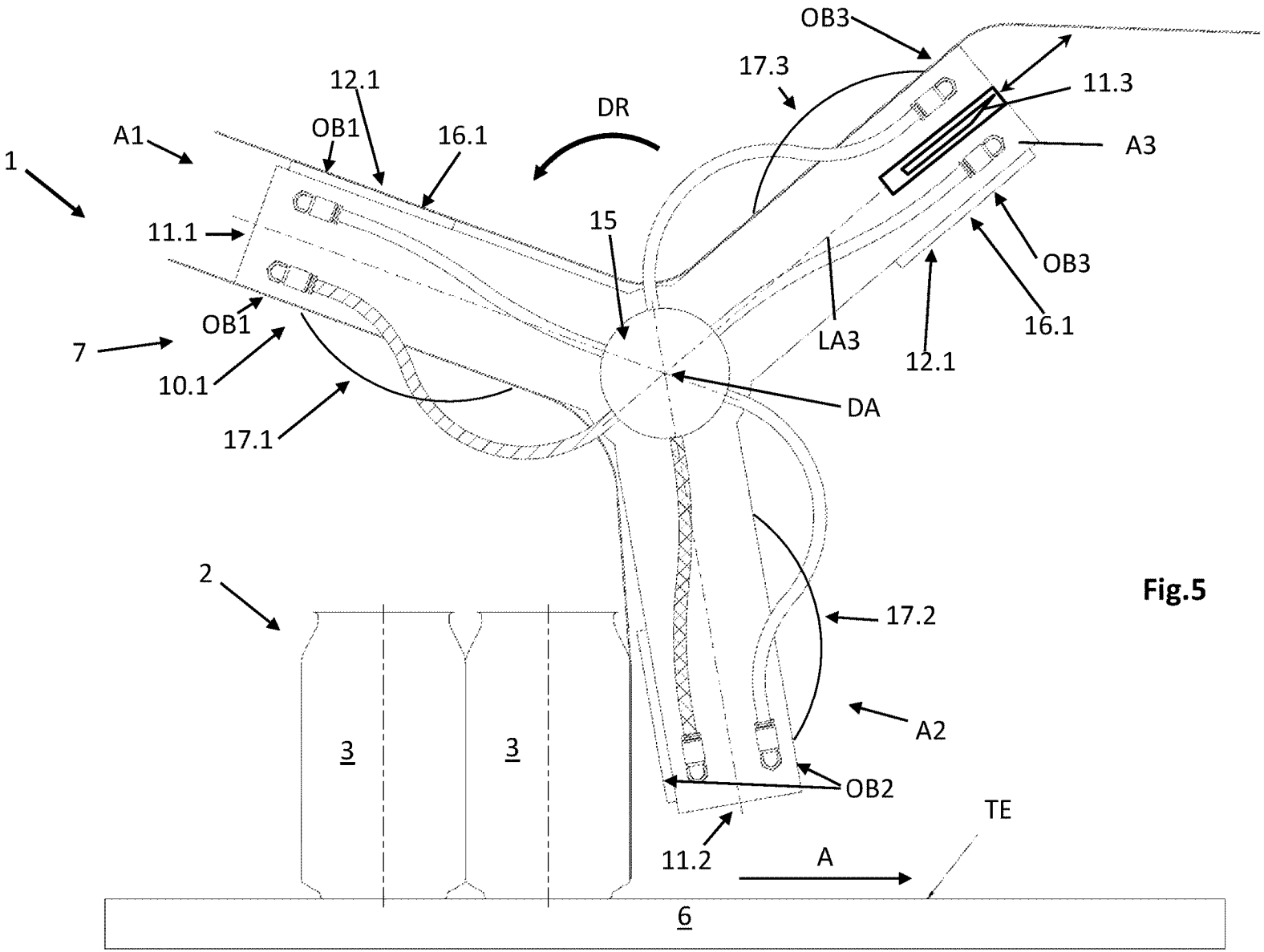

A holder 10.1, 10.2, 10.3 of a corresponding arm A1, A2, A3 comprises, on its associated rear side RS1, RS2, RS3, a spring sheet 17.1, 17.2, 17.3, best seen in FIG. 5. The spring sheet 17.1, 17.2, 17.3 is cambered away from the arm's longitudinal axis LA1, LA2, LA3.

Preferably, the rear side RS1, RS2, RS3 has several such spring sheets 17.1, 17.2, 17.3. The illustrated embodiment shows three parallel spring sheets 17.1, 17.2, 17.3 oriented along the longitudinal axis LA1, LA2, LA3 on the associated arm A1, A2, A3 in the region of their respective holders 10.1, 10.2, 10.3. The spring sheets 17.1, 17.2, 17.3 absorb shocks that result from contact between the arm A1, A2, A3 and the bundle 3. This protects the arm A1, A2, A3 from excessive wear and damage.

The free end of each arm A1, A2, A3 includes an overrun sensor 18.1, 18.2, 18.3 on a front side VS1, VS2, VS3 thereof. The overrun sensor 18.1, 18.2, 18.3 detects contact between a corresponding bundle 3 and the arm A1, A2, A3. Embodiments include those in which the overrun sensor 18.1, 18.2, 18.3 is a force sensor and those in which it is a contact sensor. The signal from the overrun sensor 18.1, 18.2, 18.3 provides a basis for controlling or regulating the applicator's further rotation.

The applicator unit 7 also includes a location sensor 19 that detects the rotational position of the arms A1, A2, A3. The location sensor 19 is preferably between the transport plane TE and the axis-of-rotation DA Referring now to FIGS. 4 and 5, a pressure distributor 15 places the pneumatic interfaces 12.1, 12.2 in communication with a source of pressure. This can be a negative pressure or a positive pressure depending on whether the handle 4 is to be gripped or ejected. The pressure depends on the time-varying position of the relevant arm A1, A2, A3 as the applicator 7 rotates. As used herein, "negative pressure" and "positive pressure" refer to pressures that are below and above ambient atmospheric pressure, respectively.

A displacer 14 causes displacement of the pneumatic interfaces 12.1, 12.2 along the arm's longitudinal axis LA1, LA2, LA3. This makes it possible to adjust the height of the pneumatic interface 12.1, 12.2 above the transport plane TE on which the bundles 3 are being conveyed. The displacer 14 operates mechanically or electromechanically. A motor, which has been omitted for clarity, drives the displacer 14 in a controlled and/or regulated manner.

Figure 2A:
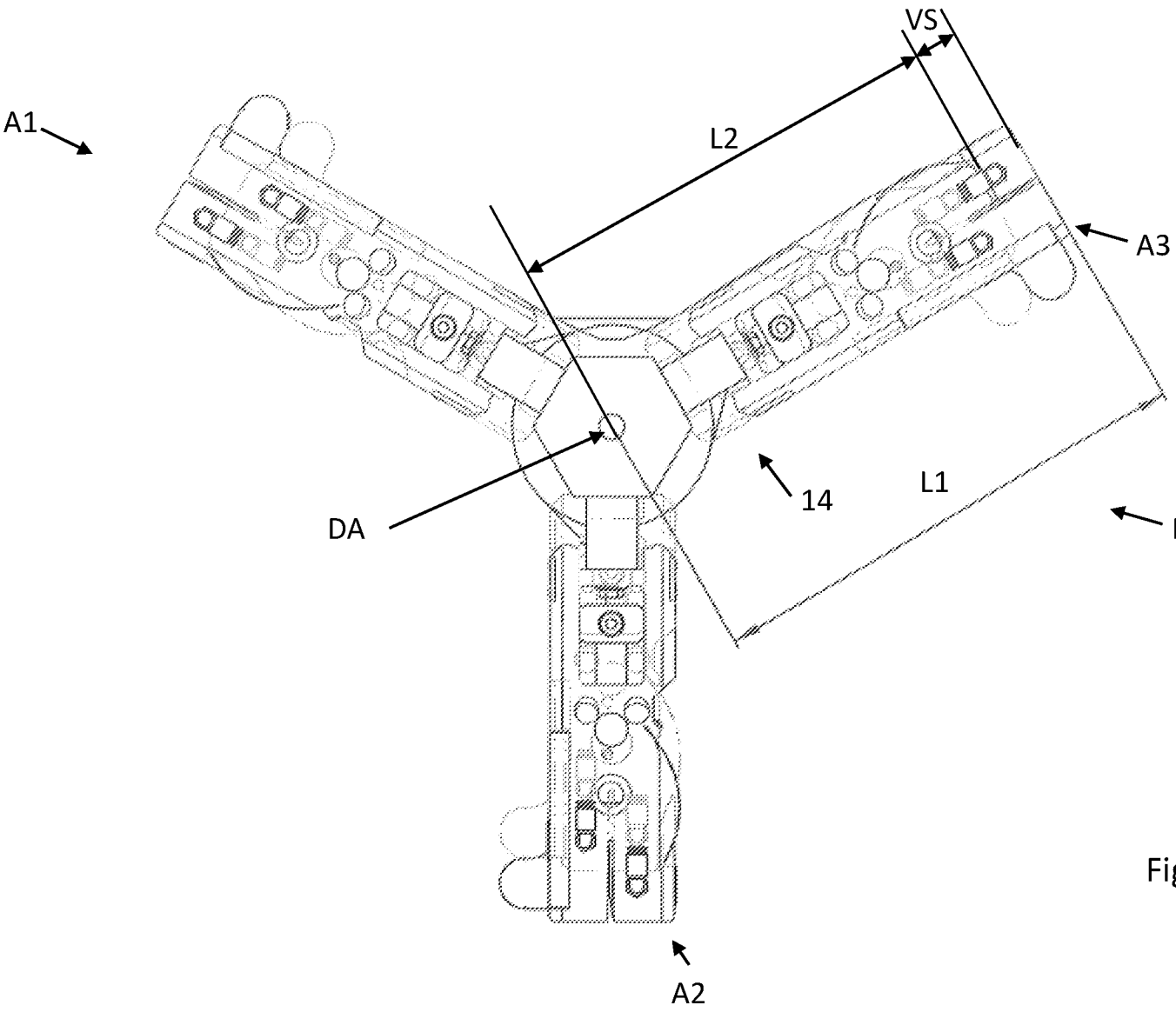
FIGS. 2*a* and 2*b* show an applicator from the apparatus of claim 1 in a retracted and extended position.
Figure 2B:
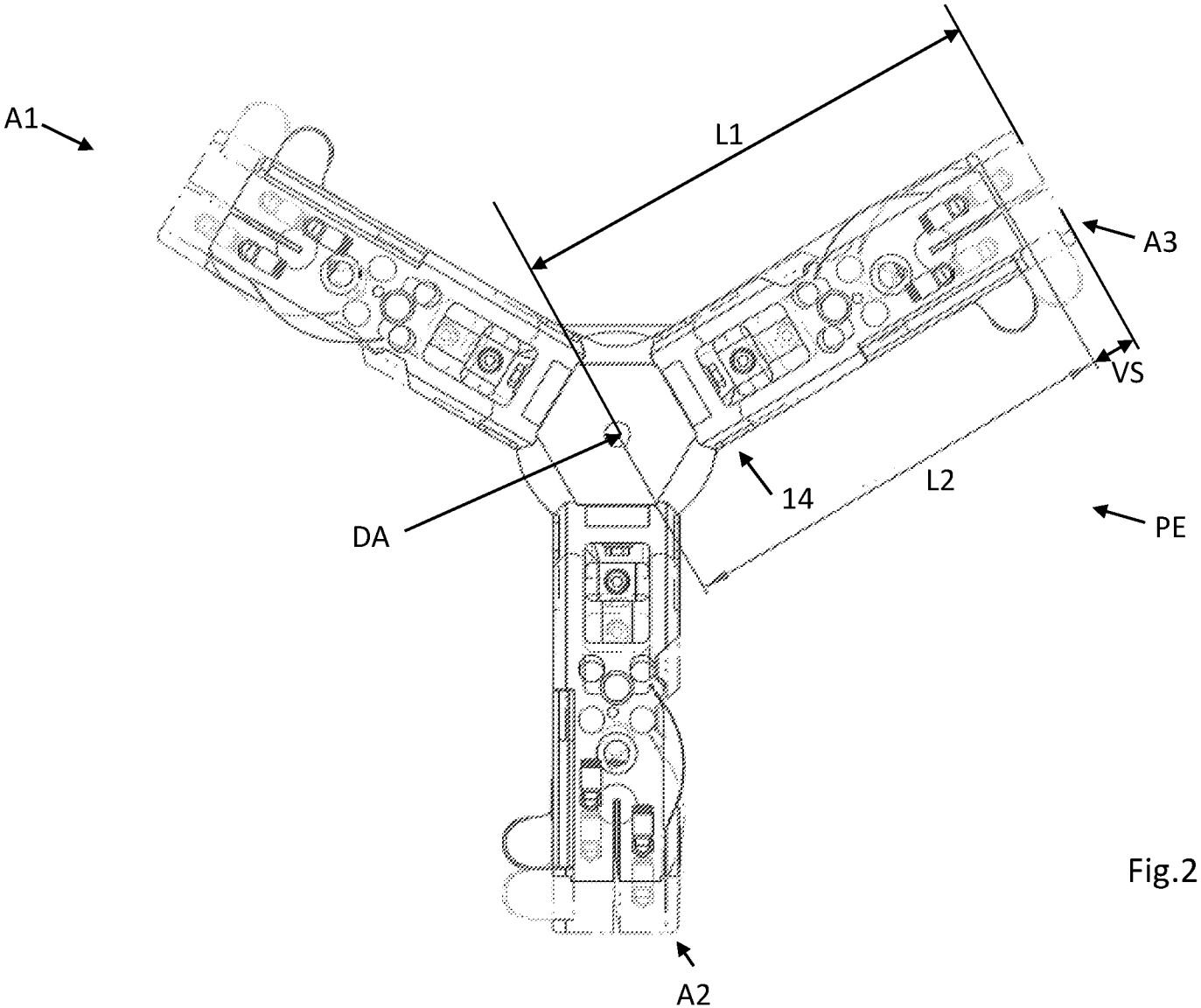

Referring now to FIG. 2*a*, the displacer 14 causes a pneumatic interface 12.1, 12.2 to be located between a first distance L1 and a second distance L2 from the applicator's axis-of-rotation DA. The difference between the first and second distances L1 and L2 corresponds to an adjustment path VS. In some embodiments, this difference is between one and fifteen centimeters. Among these are embodiments in which the difference is between three and ten centimeters. A particularly suitable choice of a difference is about five centimeters.

In some embodiments, the displacer 14 displaces the holder 10.1, 10.2, 10.3, with its corresponding pair of pneumatic interfaces 12.1, 12.2, along the arm's longitudinal axis LA1, LA2, LA3.

Referring back to FIG. 1, the arm A1, A2, A3 comprises a proximal arm section 20.1 and a distal arm section 20.2. The displacer 14 displaces the distal arm section 20.2 relative to the proximal arm section 20.1 along the associated longitudinal axis LA1, LA2, LA3. The holder 10.1, 10.2, 10.3, with its pneumatic interface 12.1, 12.2 formed thereon, is arranged on the respective distal arm section 20.2.

The displacer 14 moves the distal arm section 20.2 between a retracted position PE and an extended position PA relative to its corresponding proximal arm section 20.1 such that the arm's length transitions between first and second lengths L1 and L2. Preferably, the displacer 14 carries out the displacement continuously rather than discretely, thus permitting any intermediate length between the first and second lengths L1, L2 to be achieved.

Figure 3B:
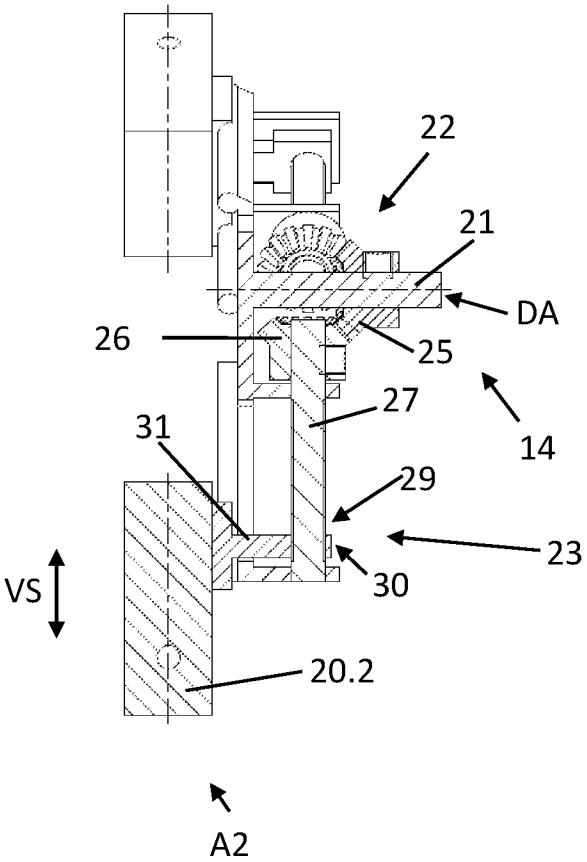
FIGS. 3*a* and 3*b* show a displacer used in the apparatus of FIG. 1.

Referring to FIG. 3*b*, when a motor turns a drive shaft 21 of a right-angle gear 22, the displacer 14 transforms this motion into rotation of a worm gear 23, which then translates the distal arm section 20.2 between the retracted and extended positions PE, PA.

Figure 3A:
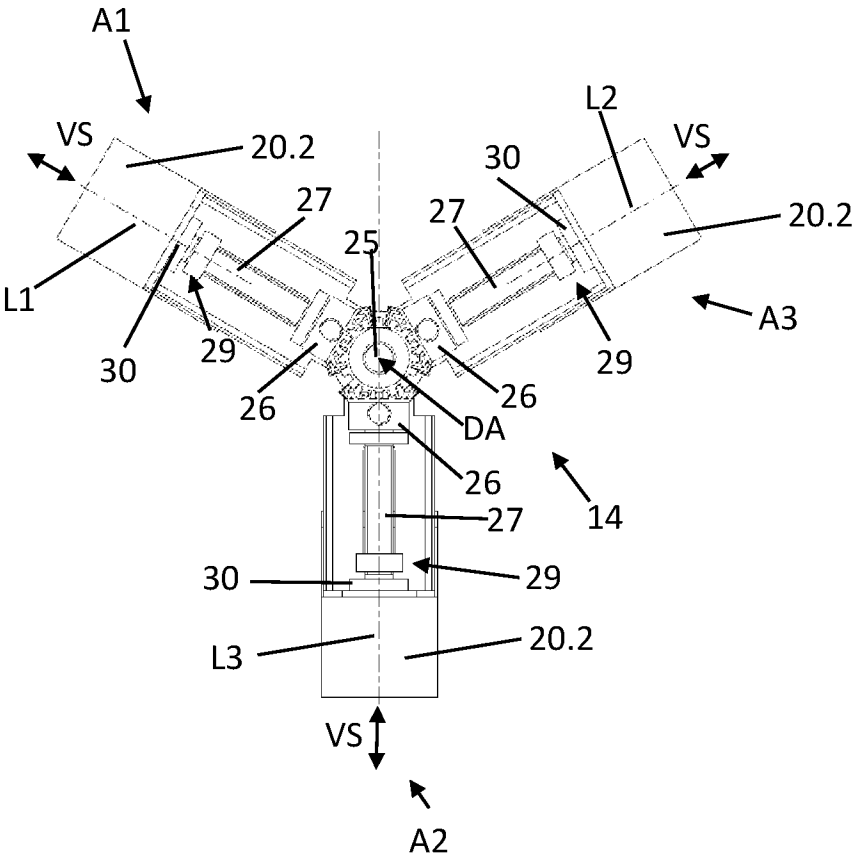

Referring to FIG. 3*a*, in some embodiments, the displacer 14 comprises a right-angle gear 22 interacting with all the arms A1, A2, A3 using a first gear wheel 25 that is arranged on the drive shaft 21 but that does not rotate with the drive shaft 21. The first gear wheel 25 drives three further drive wheels 26, which are arranged non-rotationally on proximal ends of corresponding drive shafts 27 that extended radially away from the drive shaft 21 to form a star-like arrangement.

Each of the drive shafts 27 comprises, at its distal end, a threaded section 29 of a worm gear 23 or a spindle section, which is arranged non-rotationally on the corresponding drive shaft 27. The threaded section 29 couples to a threaded nut 30 that makes it possible to mechanically translate a displacement carriage 31 that is coupled to the corresponding distal arm section 20.2.

The worm gear 23 couples the rotation of the drive shaft 27 to the threaded nut 30 at the threaded section 29, which then interacts with the carriage 31, thus translating the carriage 31 and the distal arm section 20.2 coupled to the carriage 31. As a result, the displacer 14 converts rotation of the drive shaft 21 into translation of a distal arm section 20.2.

In an alternative embodiment, also described in relation to FIGS. 3*a*, 3*b*, a right-angle gear 22 transfers rotation to a spindle, or movement screw. A spindle nut, which is rigidly connected to the carriage 31, transforms this into a translation of the carriage 31. In such embodiments, the right-angle gear 22 comprises a central bevel gear and each arm has a corresponding bevel gear.

In either case, the arms A1, A2, A3 are length-adjustable to accommodate different carrying handles 4 of differing lengths.

A handle 4 that is attached to bundle 3 follows a path above the bundle 3 and thus defines a space into which a person's hand can be inserted to carry the bundle 3. This path has a "camber." When the camber is small, it is difficult to squeeze a hand between the handle 4 and the bundle 3. When the camber is large, the bundle 3 may swing too much when carried. It is therefore useful to control the camber.

Figure 8B:
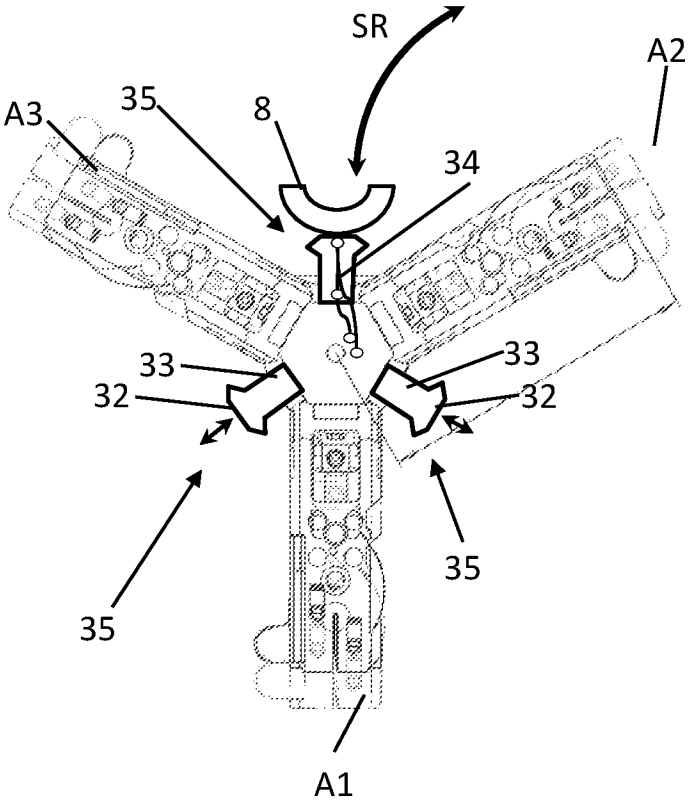
FIGS. 8*a* and 8*b* show different embodiments of a suction pad in the bend of the apparatus of FIG. 1.
Figure 8A:
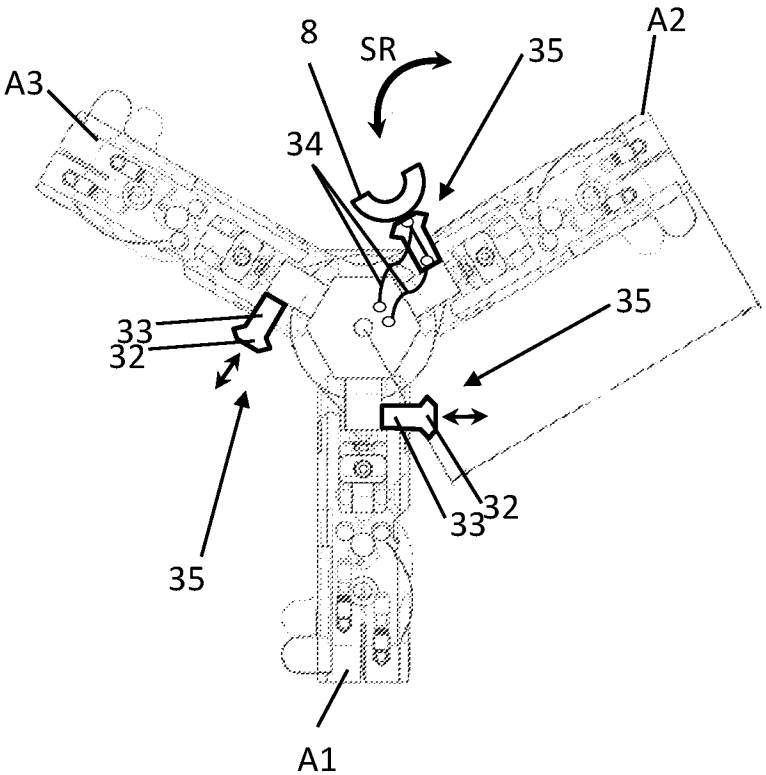

An alternative embodiment, which is shown in FIGS. 8*a* and 8*b*, features stops 35. These make it possible to set the camber of the carrying handle 4 above the bundle 3. The further a stop 35 projects, the smaller the camber will be. This is achieved by setting the length of the handle 4 based on the location of the stop 35. Each stop 35 has a pneumatic coupler 32 connected to a negative pressure source via a pneumatic line 34. A stop 35 is thus able to hold a handle 4 using suction. In FIG. 8*a*, the stops 35 are at proximal ends of each arm A1, A2, A3. In FIG. 8*b*, the stops 35 are located at the bends 13.1, 13.2, 13.3 between the arms A1, A2, A3

In some embodiments, a mover 33 moves the pneumatic coupler 32 perpendicular to the axis of rotation DA and/or parallel to the corresponding longitudinal axis LA1, LA2, LA3, as shown by the double-arrows in FIGS. 8*a* and 8*b*. The mover 33 moves the pneumatic coupler 32 mechanically, and preferably electromechanically using a motor that is operated in a controlled or regulated manner. In some embodiments, the mover 33 includes a pneumatic cylinder. In others, the mover 33 operates in the same way as the displacer 14. As a result, it is possible to adjust the distance between the pneumatic coupler 32 and the axis of rotation DA and the distance between the pneumatic coupler 32 and pneumatic interface 12.1, 12.2.

It some embodiments, the pneumatic coupler 32 couples to an overpressure rather than to an underpressure. In such embodiments, the pressure delivered via the pneumatic coupler 32 depends on its rotational position.

Alternative embodiments of the stopper 35 avoid a pneumatic coupler 32 altogether. Such a stopper 35 operates mechanically only. Such embodiments feature one or more holding fingers to hold the carrying handle 4 securely in contact with the stopper 35 during the rotation.

In still other embodiments, the stopper 35 is configured as a format part whose perpendicular extension is not adjustable. Instead, the stopper 35 is inserted into a receiver element and, if necessary, replaced by hand.

The pressure distribution assembly 15 imposes, at the pneumatic coupler 32 either an underpressure or an overpressure. The choice depends on the applicator's rotational position. To achieve this time-dependent distribution of pressures, it is useful to assign an electrically controlled valve group or a multi-way valve to the pneumatic coupler 32. Each such valve group connects to a corresponding source via a suction line and a high-pressure line. A controller uses a sensor signal or control signal to switch the valve group accordingly to either hold the handle 4 by suction or to push it away with a pulse of positive pressure.

The pneumatic coupler 32 is configured to obtain a defined length of the carrying handle 4 by using negative pressure and to hold it within a bend 13.1, 13.2, 13.3 so that it contacts the bend 13.1, 13.2, 13.3 in a desired low position.

Referring now to FIG. 1, the procedure for attaching a handle 4 to a bundle 3 begins with the second arm A2 located in a vertical position extending towards the transporter 6. The holders 10.1, 10.2 of the first and second arms A1, A2 hold the handle 4 at its free ends. This is carried out by the second pneumatic interface 12.2 of the second front side VS2 of the second arm A2 and the first pneumatic interface 12.1 of the first rear side RS1 of the first arm A1 using suction.

To obtain a defined length of the carrying handle 4, the pneumatic coupler 32 holds the handle 4 against a bend 13.3, also using suction or, alternatively, using a pivoting finger. The adhesive sections on the free-end side of what will later be the carrying handle 4 project as loose ends outwards over the first and second arms A1, A2.

Figure 4:
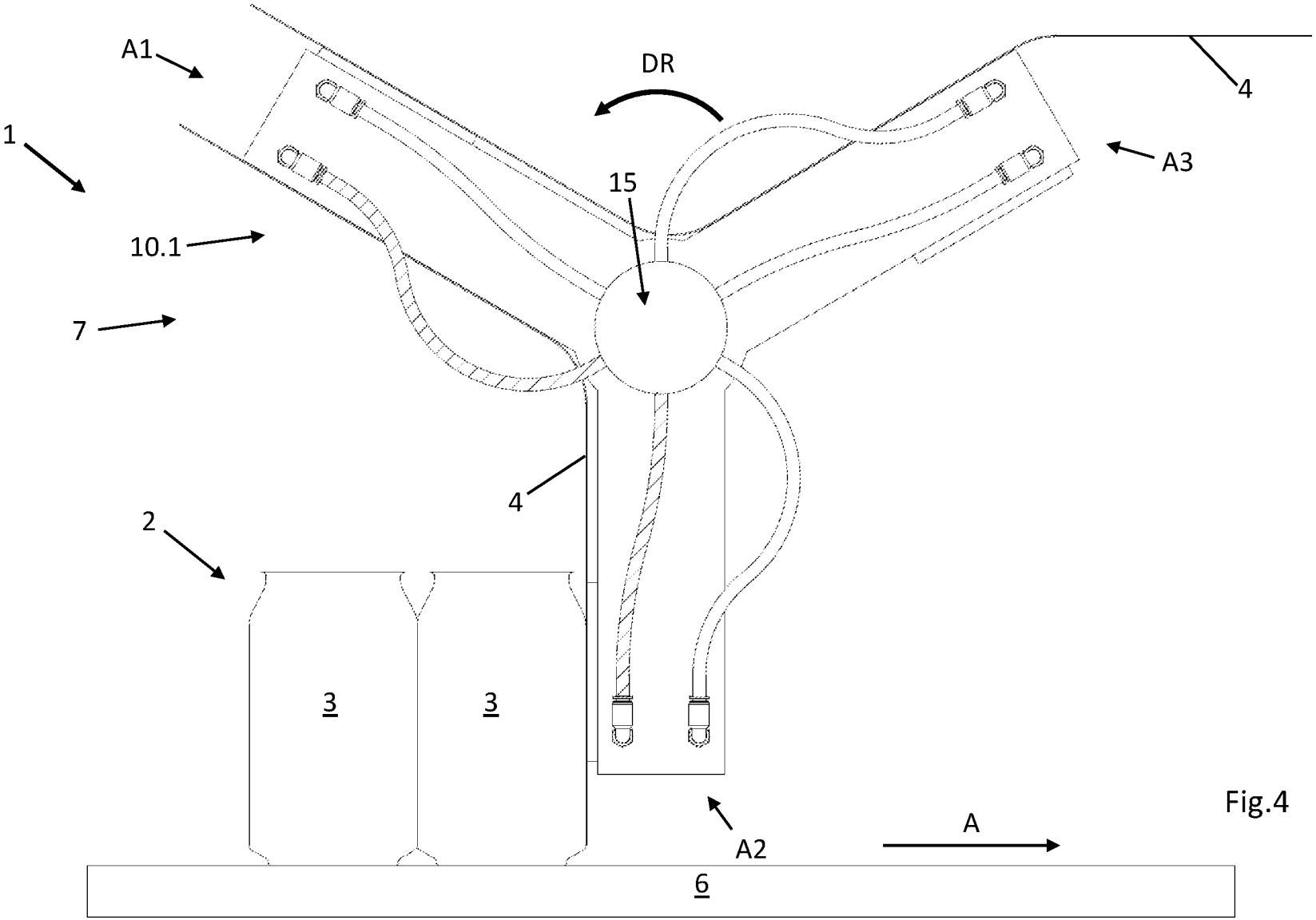
FIG. 4 to FIG. 7 show different operational states of the apparatus in FIG. 1.

The self-adhesive side of what will later be the carrying handle 4 points in the direction of the approaching bundle 3. Eventually, the transporter 6 brings the bundle 3 into contact with the vertical second arm A2 and therefore against the self-adhesive free end of the carrying handle 4 being held at the first and second arms A1, A2. This fixes the adhesive section on the free-end side to one side of the bundle 3, as seen in FIG. 4.

At this point, the second pneumatic interface 12.2 of the second holder 10.2 of the second arm A2 provides an overpressure to detach the handle 4 from the second holder 10.2.

Contact with the bundle 3 against the second arm A2 causes the overrun sensor 18.2 to generate a sensor signal. This causes the applicator 7 to rotate clockwise, as seen in FIG. 5.

FIG. 5 also shows the cutting tool 11.3 of the third arm A3 as it begins to move linearly along the arm's axis LA3 to detach another handle 4 from an endless strip of handles while the strip is under tension as a result of being pulled by the rotating applicator 7.

Figure 6:
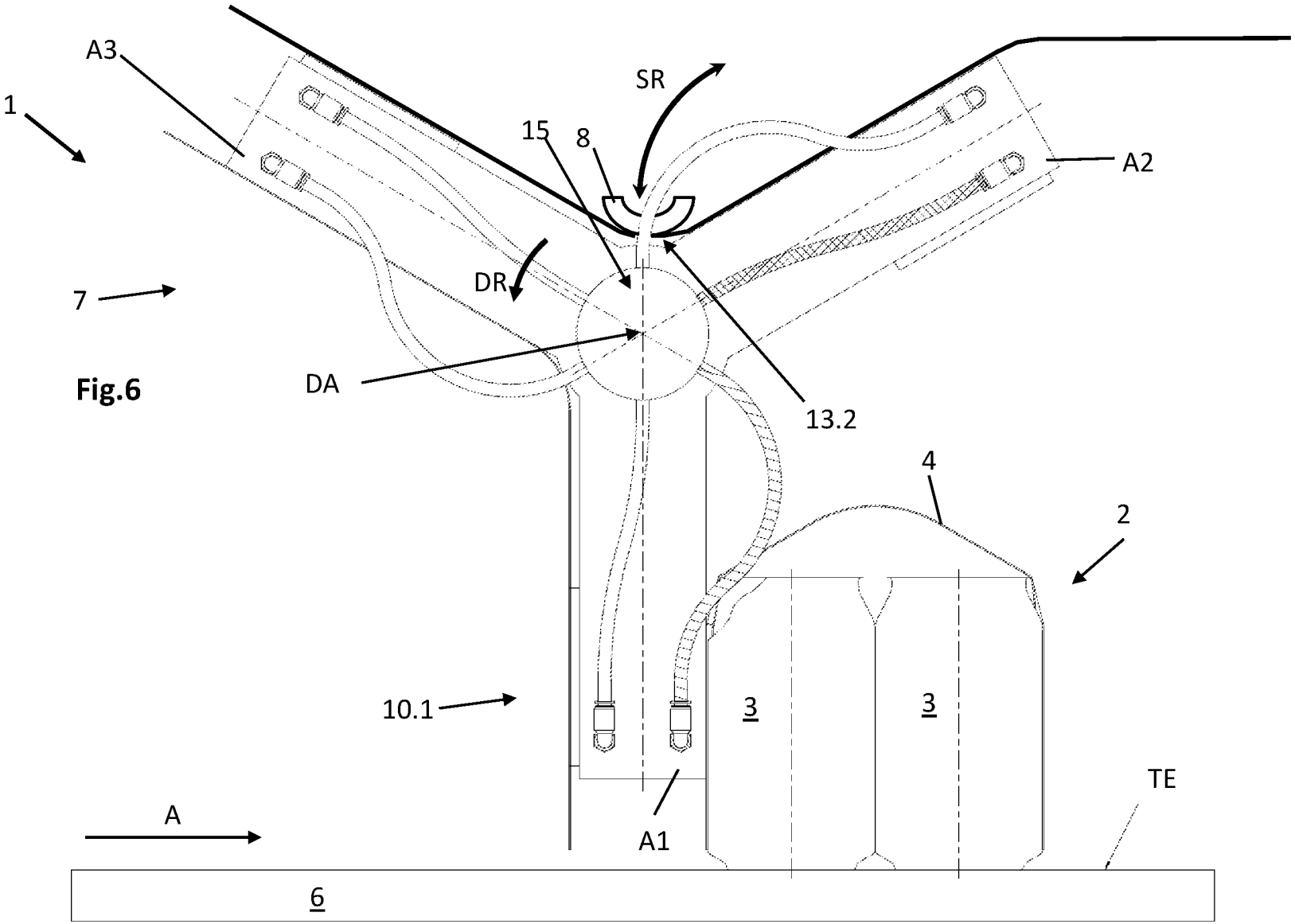
Figure 7:
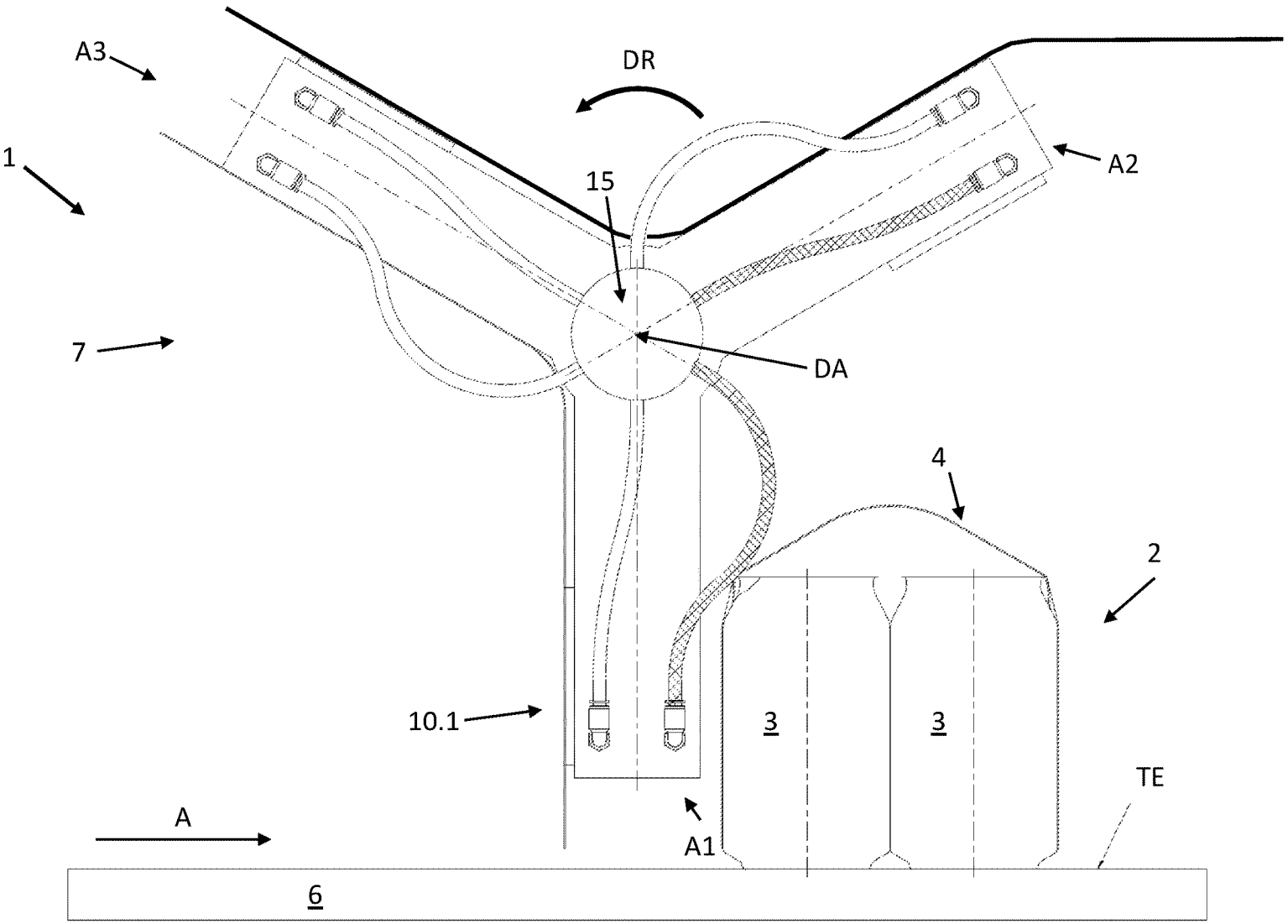

Referring now to FIG. 6, the applicator's rotation speed is adjusted relative to that of the transporter 6 such that the first arm A1 reaches the vertical position in time to press the other end of the handle 4 against the rear side of the bundle 3. This presses the free end of the handle, which has the adhesive section on it, against the bundle 3. This completes the attachment of the handle 4.

FIG. 6 also shows a contact body 8 as it pivots in the direction of double-arrow SR to place the newly-introduced handle 4 under tension between the ends of the second and third arms A2, A3, where it is held by pneumatic interfaces 12.1, 12.2. The contact body 8 pushes the handle 4 against the bend 13.2 so that it can be gripped and held by the pneumatic coupler 32.

To release the carrying handle 4 from the holding position shown, the pneumatic coupler 32 provides a burst of overpressure. Each bend 13.1, 13.2, 13.3 has a pneumatic coupler 32. However, only one contact body 8 is needed. A pivot drive to move the contact body 8 is secured to the apparatus 1 and interacts with the applicator 7.

The first pneumatic interface 12.1 of the first holder 10.1 of the first arm A1 is also subjected to an overpressure burst at least during and/or after the pressing of the free-end side adhesive sections onto the bundle 3. This causes the carrying handle 4 to be released from the first holder 10.1.

The bundle 3, having been provided with a carrying handle 4, is conveyed further by means of the transporter 6 in the transport direction A.

The invention has been described heretofore by way of exemplary embodiments. It is understood that a large number of modifications or derivations are possible without departing from the scope of protection of the invention as defined by the claims.

Having described the invention and a preferred embodiment thereof, what is claimed as new and secured by Letters Patent is:

1. An apparatus for attaching a handle to a bundle that is being conveyed in a transport direction by a transporter, said handle being a self-adhesive carrying handle, wherein said apparatus comprises an applicator that is driven by a motor to rotate about a horizontal axis that is transverse to said transport direction, wherein said applicator is a carrying-handle applicator configured to convey an endless band over a package and to detach said endless band to form a carrying handle having an adhesive section on a free end thereof, wherein said band has sections of adhesive layer, wherein said applicator comprises three arms, wherein each of said arms extends radially from said horizontal axis along an arm axis, each pair of arms being separated by a corresponding bend, wherein each of said arms comprises a cutter, a holder, and a displacer, wherein said holder comprises a pneumatic interface for using negative pressure to hold or guide said endless band as well as said carrying handle that results therefrom, and wherein said displacer is configured to displace said pneumatic interface along a direction defined by said arm axis.

2. The apparatus of claim 1, wherein said displacer is configured to displace said pneumatic interface along an adjustment path that extends between first and second distances from said horizontal axis.

3. The apparatus of claim 1, wherein each of said holders is configured to be displaced by said displacer along said arm's axis.

4. The apparatus of claim 1, wherein said arm comprises proximal and distal arm sections, wherein said holder is disposed at said distal arm section, and wherein said displacer causes relative movement between said proximal and distal arm sections.

5. The apparatus of claim 1, wherein said displacer causes said arm to transition between extended and retracted positions, wherein said transition includes changing a length of said arm.

6. The apparatus of claim 1, wherein said displacer is configured to cause a length of said arm to change continuously between a first length and a second length, whereby said arm is able to assume any intermediate length therebetween.

7. The apparatus of claim 1, wherein said displacer comprises a right-angle gear and a worm gear, wherein said work gear converts rotational motion of said right-angle gear into translational movement of a distal section of said arm relative to a proximal section of said arm.

8. The apparatus of claim 1, further comprising an adjustable stop, wherein said stop has a perpendicular extension that extends radially way from said horizontal axis, wherein said stop is disposed at a proximal end of said arm.

9. The apparatus of claim 1, further comprising a stop disposed at one of a proximal end of said arm and a bend section disposed between adjacent arms, said stop comprising a pneumatic coupler configured to apply a negative pressure to hold said handle.

10. The apparatus of claim 1, further comprising a stop disposed at one of a proximal end of said arm and a bend section disposed between adjacent arms, said stop comprising a pneumatic coupler, said apparatus further comprising a pressure distributor configured to apply either a negative pressure and a positive pressure to said pneumatic coupler based on a rotational position of said applicator.

11. The apparatus of claim 1, further comprising a mover and a stop disposed at one of a proximal end of said arm and a bend section disposed between adjacent arms, said stop comprising a pneumatic coupler, wherein said mover is configured to displace said pneumatic coupler perpendicular to said horizontal axis and parallel to said arm axis.

12. The apparatus of claim 1, further comprising a stop disposed at one of a proximal end of said arm and a bend section disposed between adjacent arms, said stop comprising a pneumatic coupler that is separated from said horizontal axis by a distance, wherein said distance is adjustable.

13. The apparatus of claim 1, further comprising an adjustable stop, wherein said stop has a perpendicular extension that extends radially way from a bend section between two arms, wherein said stop is disposed at a said bend section.

14. The apparatus of claim 1, further comprising a replaceable stop disposed at one of a proximal end of said arm and a bend section disposed between adjacent arms.

15. A method for comprising using an apparatus to attach a handle, said apparatus comprising an applicator that is driven by a motor to rotate about a horizontal axis-of-rotation that is transverse to said transport direction, wherein said applicator is a carrying-handle applicator configured to convey an endless band, which has sections of adhesive layer, over a package and to detach said endless band to form a carrying handle having an adhesive section on a free end thereof, wherein said applicator comprises three arms, each of which extends radially from said axis-of-rotation along a arm axis, each pair of arms being separated by a corresponding bend section, wherein each of said arm comprises a displacer, a holder, and a cutter, wherein said holder is configured to hold and/or press, wherein said holder comprises a pneumatic interface, wherein said holder uses negative pressure to holds and/or guide said endless band as well as said carrying handle that results therefrom, wherein said displacer is configured to displace said pneumatic interface along a direction defined by said arm's arm axis, said method comprising conveying said endless band over said package, cutting said band to form said carrying handle, which has an adhesive section on a free end thereof, and pressing said handle onto said package.

* * * * *